US007131783B1

(12) United States Patent
DeRoma

(10) Patent No.: US 7,131,783 B1
(45) Date of Patent: Nov. 7, 2006

(54) TOILET BOWL BRUSH WITH FLUID DISPENSER

(76) Inventor: Flavio DeRoma, 400 Corporate Dr., Blauvlet, NY (US) 10913

( * ) Notice: Subject to any disclaimer, the term of this patent is extended or adjusted under 35 U.S.C. 154(b) by 0 days.

(21) Appl. No.: 11/060,097

(22) Filed: Feb. 17, 2005

(51) Int. Cl.
*A46B 15/00* (2006.01)
*A46B 11/00* (2006.01)

(52) U.S. Cl. ..... 401/15; 401/291

(58) Field of Classification Search ..... 401/15, 401/291, 278, 279
See application file for complete search history.

(56) References Cited

U.S. PATENT DOCUMENTS 496,181 A 4/1893 Bohner
3,723,015 A 3/1973 Wissler
D367,174 S 2/1996 Matossian
5,888,002 A 3/1999 Fenstersheib
5,984,555 A * 11/1999 Samad ..... 401/176
6,065,891 A 5/2000 Rehman et al.
6,287,037 B1 * 9/2001 Hay ..... 401/273
D452,080 S * 12/2001 Petner ..... D4/114
6,623,201 B1 * 9/2003 Brumlik ..... 401/279

* cited by examiner

*Primary Examiner*—David J. Walczak
(74) *Attorney, Agent, or Firm*—Stephen E. Feldman P.C.

(57) ABSTRACT

A toilet bowl brush with an integrated refillable reservoir for storing and dispensing cleaning fluids. The toilet bowl brush, also, has (1) a wide top shield to protect user's hand from contamination during the cleaning process, (2) a non-slip soft handle with a thumb button for dispensing the cleaner, (3) a mechanism for dispensing the fluid and (4) a removable tip for changing the brush tip when it becomes worn. The brush tip includes perforations which allow the fluid to be dispensed through the tip by gravitational force.

9 Claims, 2 Drawing Sheets

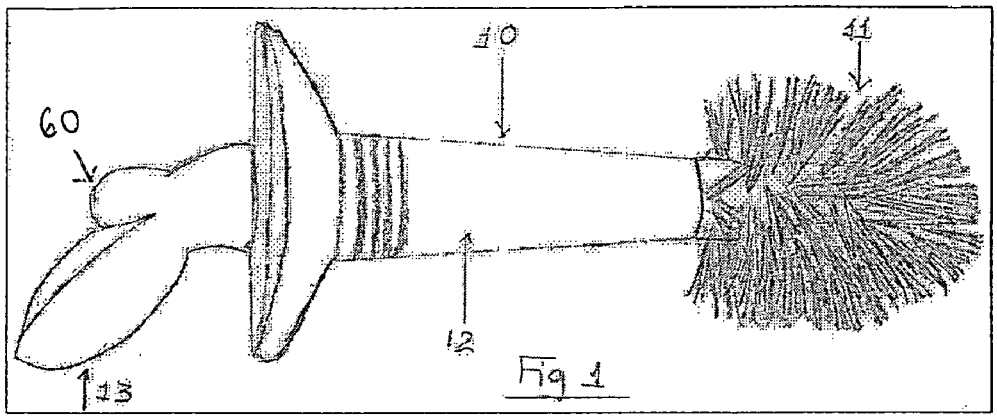
Fig 1
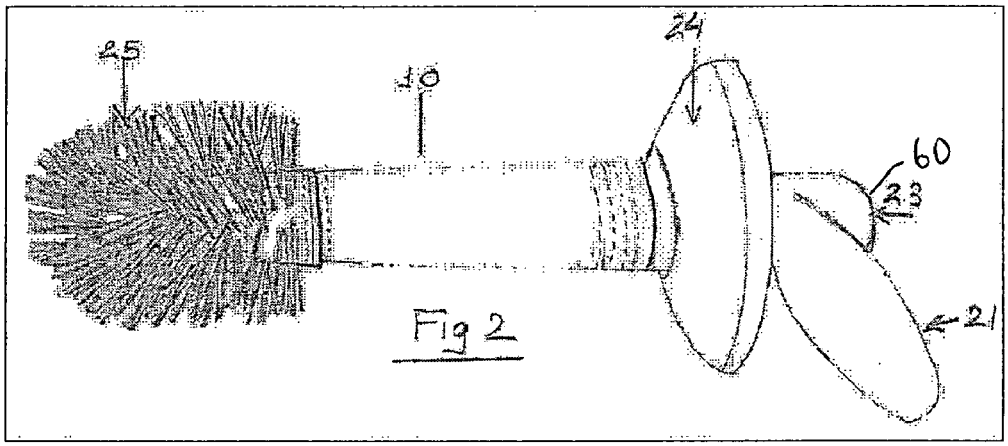
Fig 2
Fig 3
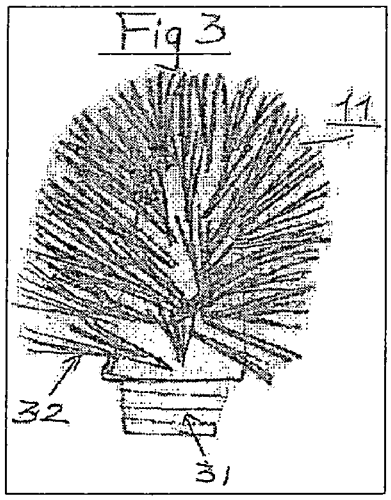

44
43
42
41
45
46
12

13
60
51

TOILET BOWL BRUSH WITH FLUID DISPENSER

FIELD OF INVENTION

The present invention relates to brushware for cleaning toilet bowls in general. The present invention, in particular, relates to a fluid dispensing hand held brush for cleaning toilet bowls.

BACKGROUND INFORMATION

The cleaning of a toilet bowl, in the bathroom, is often considered the task of house cleaning. A brush secured at the end of an elongated handle is usually used for cleaning a toilet bowl. Cleaning chemicals, which are often used when cleaning such bowls, tend to stain the bowls and hard water retained in the bowel usually leaves an undesirable residue in the bowl.

The available brushware for cleaning of toilet bowls usually have elongated handles with brush tip. The cleaning agent to be used has to be taken from a separate container. The handles of the existing toilet brushes are long which makes the cleaning of the inner bowl area difficult. Also, once the bristles of the brush tip are worn or broken, the entire brush has to be disposed off.

The use of liquid dispensing brushes is known in the prior art. More specifically, liquid dispensing brushes heretofore devised and utilized are known to consist basically of familiar, expected and obvious structural configurations, notwithstanding the myriad of designs encompassed by the crowded prior art, which have been developed for the fulfillment of countless objectives and requirements. These types of squeezable brushes are usually used for applying hair color.

Design Pat. 452,080 S granted to Petner, describes a bottle brush. The ornamental design for a bottle brush showed the brush tip attached on a bottle. The bottle can be used to the store cleaning agents or disinfectants.

The Matossian Design Pat. 367,174 describes a toilet bowl cleaning brush with liquid dispenser. The liquid dispenser can be used to store the cleanser. The brush bristles are secured on the top of the dispenser by the means of screw threads.

U.S. Pat. No. 3,723,015 granted to Bernhard, et al., discloses a toilet brush. It is equipped with a rinsing brush as well as a brush head on a brush handle. The brush handle has a container for cleaner or disinfectant is detachably mounted. The container is connected to the bristle head by a tube that can be closed off by a valve.

U.S. Pat. No. 5,888,002 granted to Fensteheib R. J. describes a disposable toilet cleaning brush. The brush is provided with a squeezable reservoir or hollow bristles in the brush tip for storing cleaning agent. The cleaning agent can be taken in dried or liquid form and may be dispensed from brush bristles. The brush tip, after cleaning process can be removed from the brush and may be disposed.

U.S. Pat. No. 6,065,891, granted to Rehman et. al. describes a squeezable liquid dispensing brush provided with an inboard and an outboard extent. Inboard extent is provided with a plurality of bores formed therein. Each of the plurality of bristles has an inboard end mounted on a lower surface of outboard extent. The liquid flows through the outboard extent.

German patent 496,181 shows hollow bristles to which end a liquid cleaning agent, supplied through a brush handle, can be ejected. The bristles are angled outside from the center of dispensing head. The bristle hollows are constant diameter.

The problems of hygiene and self-protection under contamination are not tackled in prior art. The brush tip once worn cannot be changed. The aforementioned reasons are acknowledged in designing the present invention.

BRIEF SUMMARY OF INVENTION

The present invention's toilet bowl brush is designed with an integrated liquid dispenser for storing and dispensing a liquid cleaning agent. The brush comprises a non-slip soft brush handle and a mechanism for dispensing the cleaning agent is activated using a button located on the handle.

The liquid agent flows through the mechanism by the force of gravity. That is, there is an elongated tube passing through the storage container, which carries the cleaning agent to the brush tips. The brush tips are perforated to allow the cleaning agent to flow out of the brush tips. The brush tip is removable from the main storage body and can be changed when worn out. The handle of the brush is provided with a wide top to protect the user's hand from contamination. The brush tip and handle are connected through the mechanism for dispensing the liquid.

An object of this invention is that the brush tip once worn can be changed. The wide top shield in the present invention facilitates the safety and cleanliness of the user's hand from contamination. The mechanism for dispensing liquid can be activated using the button only, hence only desired amount of cleaning agent is utilized and wastage is avoided.

BRIEF DESCRIPTION OF DRAWINGS

The novel features of the present invention are set forth in the appended claims. The invention itself, however, as well as other features and advantages thereof will be best understood by reference to the following detailed description of an illustrative embodiment when read in conjunction with the accompanying figures, wherein FIG. 1 is a side view of the preferred embodiment of the present invention.

FIG. 2 is an elevational view of the present invention.

FIG. 3 is a perspective view of the brush tip of the present invention.

DETAILED DESCRIPTION OF PREFERRED EMBODIMENTS

Figure 4:
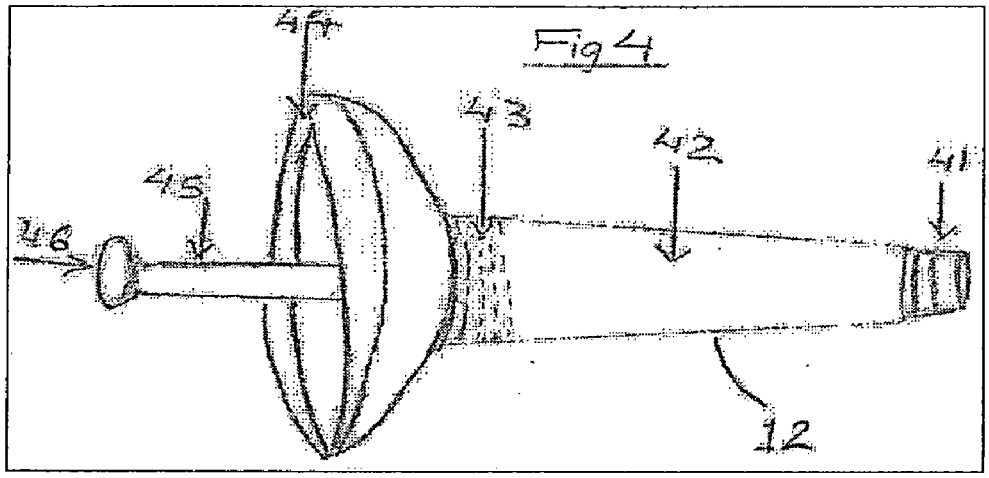
FIG. 4 is a perspective view of the storage and dispensing device of the present invention.

With reference now to the drawings, and in particular to FIGS. 1 and 2, a new toilet bowl brush embodying the principles and concepts of the present invention and generally designated numeral 10 is described. The present invention comprises a brush tip 11, a storage and dispensing device 12 and a non-slip soft brush handle 13. The brush tip, the storage and dispensing device and the brush handle are connected to each other in the usual manner forming the present invention. In the preferred embodiment, the structure of the present invention is made of plastic.

The brush tip has multiple bristle groups 25 secured over a cylindrical tubular end, where in each bristle group comprises a multiplicity of individual bristles 32. The brush tip 11 is 2 to 4 inches approximately in length with the individual brush bristles 32 approximately 1 to 2 inches in length. The individual bristles 32 are made of nylon or plastic material.

The inner wall of the lower end section of the brush tip 11 has screw threads 31, referring FIG. 3. The screw threads secure the brush tip 11 on to the storage and dispensing device 12. The diameter of the brush tip is 1 to 2 inches with the diameter of the lower end section of the brush tip being less than the diameter of the upper end section of brush tip. When the brush tip 11 is rotated over the storage/dispensing device 12, the brush tip gets secured. The diameter of the lower end section of the brush tip 11 is more than the diameter of the upper end section of the storage and dispensing device 12. The brush tip 11 is approximately half the length of storage and dispensing device 12. The brush tip has perforations near the brush bristles. The cleaner flows out of the perforations when dispensing mechanism is activated.

Referring FIG. 4, a tubular hollow shaft structure 42 comprises the main part of the storage and dispensing device 12. The tubular shaft is 4 to 6 inches approximately in length. The tubular shaft 42 encloses the mechanism for dispensing the cleaner. The tubular shaft also stores the cleaning agent inside its walls. The storage and dispensing device 12 secures the brush tip 11 at one end and the brush handle 13 at the other end. The diameter of the tubular shaft 42 is less towards the brush tip and increases tapering towards the brush handle. The screw thread 41, on the outer wall of the upper tubular section of the storage and dispensing device 12, secure the brush tip to the storage and dispensing device. The diameter of the upper end section of the storage and dispensing device is less than the diameter of the lower end section of the brush tip. The screw threads 31 of the brush 11 tip fit over the screw threads 41 of the storage and dispensing device 12. The screw threads 43 on the inner wall of the lower end section of the main tubular shaft 42 to secure the brush handle to the storage and dispensing device.

The wide top shield 24 is provided at the lower end of the storage and dispensing device. The wide top shield covers the user's hand from contamination during the cleaning process. The wide top shield is approximately 2 to 6 inches in diameter. The central part of the shield is attached to the main shaft of the storage and dispensing device. The outer mouth of brim wall 44 of the shield flares open as the diameter of the shield increases from the shaft towards the outer end.

The mechanical means to dispense the liquid cleaning agent is formed by a tubular shaft 45 enclosed inside the storage and dispensing device 42. The tubular shaft 45 of the dispensing mechanism is axially located inside the storage and dispensing device 42. The length of tubular shaft 45 of the dispensing mechanism is 6 to 8 inches approximately. The tubular shaft 45 of the dispensing mechanism has length 1 to 2 inches more than the tubular shaft 42 of the storage and dispensing device 12. The diameter of the tubular shaft 45 of the dispensing mechanism is much less than the diameter of the storage and dispensing device 12. The tubular shaft 45 of the dispensing mechanism is secured at upper end to the brush tip 11 and to the brush handle 13 at the lower end. The elongated end of the tubular shaft 45 of the dispensing mechanism has a circular disc 46. The diameter of the circular disc 46 is approximately ¼ to ½ inch. The end disc 46 fits into the hemispherical elongated end 23 of the brush handle 13. The end disc 46 is placed into the hemispherical elongated end 23 of the brush handle 13 and is movably connected to a dispensing button 60. The storage and dispensing device with the dispensing mechanism forms the main body of the brush.

Figure 5:
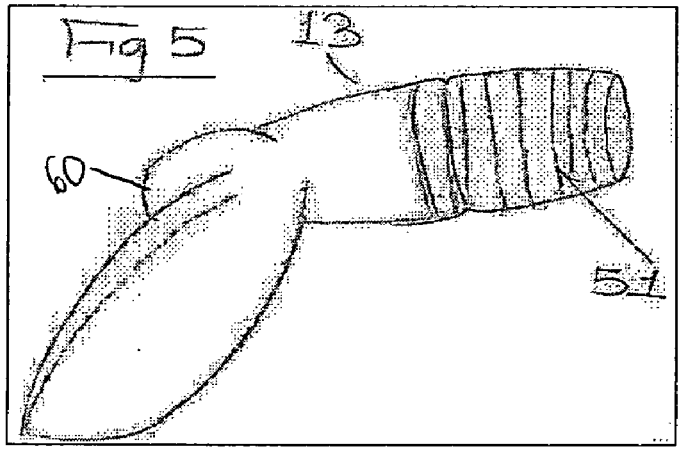
FIG. 5 is an elevational view of the brush handle of the present invention.

The brush handle 13 has a non-slip soft grip, referring to FIGS. 1, 2 and 5. The brush handle 13 has a main tubular structure and a handgrip 21 perpendicular to the main tubular body of the handle, for user to hold the brush handle. The main tubular body of the brush handle 13 has an elongated hemispherical end 23 enclosing the circular disc 46 of the dispensing mechanism. The dispensing button 60 is part of the elongated hemispherical end 23. The brush handle 13 is ergonomically shaped and resembles a handle of a gun or a squirting device. The brush handle 13 is approximately half the length of the storage and dispensing device 12. The brush handle's handle has a dispensing button 60 is located 22 on the handgrip 21 of the brush handle 13. The button 60 is located in close proximity to a user's thumb. The dispensing button 60 activates the dispensing mechanism of the storage and dispensing device 12 of the present invention 10. The handgrip 21 allows the user to firmly grasp the handle with the user's thumb in proximity to the dispensing button 60 and the other fingers wrapped around the handgrip 21. The main tubular structure of the handle has screw threads 51 on the outer walls of the upper end of the brush handle 13. The diameter of the screw threads 51 on the brush handle 13 is less than the diameter of the screw threads 41 on the storage and dispensing device 12. The screw threads 51 secure the brush handle 13 to the storage and dispensing device 12.

The dispensing button 60 when pressed by the user's thumb activates the dispensing mechanism. That is, when the dispensing button 60 is depressed the tubular shaft 45 is slidably moved in a direction parallel to the length of the storage and dispensing device 42. This, in turn, causes the shaft 45 at the brush end 11 of the storage and dispensing device 42 to move forward allowing a water tight seal (not shown) to open. Once the seal is broken, the liquid cleaning agent stored in the storage and dispensing device 12 moves in to the brush tip 11. The cleaning agent flows out of the perforations on the brush tip 11 by the force of gravity. The cleaning agent, alternatively, can be sprayed out of the brush using an integrated squirting or spraying device.

Although the illustrative embodiments of the present disclosure have been described herein with reference to the accompanying drawings, it is to be understood that the disclosure is not limited to those precise embodiments, and that various other changes and modifications may be affected therein by one skilled in the art without departing from the scope or spirit of the disclosure. All such changes and modifications are intended to be included within the scope of the disclosure.

What is claimed is:

1. A liquid dispensing toilet bowl brush having a refillable reservoir for storing and dispensing a liquid cleaning agent, comprising:

a brush tip for scrubbing surfaces;

a storage and dispensing device for storing and dispensing the cleaning agent, the storage and dispensing device having an upper end and a lower end, the brush tip being removably screwed onto the upper end the storage and dispensing device;

a brush handle, the brush handle including a main tubular structure and a handgrip, the brush handle being removably screwed onto the storage and dispensing device; and a wide-top shield for protecting a user from contamination, the wide top shield being provided at the lower end of the storage and dispensing device, whereby the handgrip of the brush handle is substantially perpendicular to the main tubular structure.

2. A liquid dispensing toilet bowl brush of claim 1 wherein said brush tip is removable.

3. A liquid dispensing toilet bowl brush of claim 1 wherein said brush tip is perforated to allow the cleaning agent to flow through.

4. A liquid dispensing toilet bowl brush of claim 1 wherein said storage and dispensing device further comprises:

a tubular hollow structure for storing the liquid cleaning agent; and a dispensing mechanism for dispensing the liquid cleaning agent.

5. A liquid dispensing toilet bowl brush of claim 4 wherein said dispensing mechanism, further comprises:

a tubular shaft; said tubular shaft connected to the brush tip at one end and the brush handle at other end.

6. A liquid dispensing toilet bowl brush of claim 5 wherein said tubular shaft is affixed with a circular disc end in a lower end section.

7. A liquid dispensing toilet bowl brush of claim 6 wherein said non-slip soft grip brush handle further comprises:

a hemispherical elongated end for enclosing the circular disc end of the dispensing mechanism; and a button for dispensing the liquid cleaning agent.

8. A liquid dispensing toilet bowl brush of claim 4 wherein said dispensing mechanism dispenses the liquid cleaning agent from the brush by force of gravity.

9. A liquid dispensing toilet bowl brush of claim 1 wherein said brush handle is non-slip soft grip handle.

* * * * *